US005503549A

United States Patent [19]

Iasella

[11] Patent Number: 5,503,549

[45] Date of Patent: Apr. 2, 1996

[54] ULTRA LOW POWER VALVE FOR THE CONTROL OF GAS FLOW

[76] Inventor: Carlo Iasella, 1232 Saxonburg Blvd., Glenshaw, Pa. 15116

[21] Appl. No.: 385,660

[22] Filed: Feb. 8, 1995

[51] Int. Cl.[6] ..... F23N 5/00

[52] U.S. Cl. ..... 431/18; 362/431; 137/78.4; 431/86

[58] Field of Search ..... 431/18, 62, 86; 137/78.4; 362/179, 431

[56] References Cited

U.S. PATENT DOCUMENTS

| | | | |
|---|---|---|---|
| 3,330,313 | 7/1967 | Kniebes | 431/18 |
| 3,723,045 | 3/1973 | Reese | 362/431 |
| 4,830,606 | 5/1989 | Dillinger . | |

*Primary Examiner*—Carroll B. Dority
*Attorney, Agent, or Firm*—Buchanan Ingersoll; Robert J. Pugh

[57] ABSTRACT

A turn down device for regulating gas flow within a gas lamp that is of the general type having a lamp post and a mantel. The device has a conduit configured to allow gas to flow therethrough and a gas supply line connected to the conduit for supplying gas under pressure. A poppet valve having a valve seat and a magnetic poppet is provided along the conduit downstream of where the supply line connects to the conduit. A solar cell is connected to the electromagnet that generates and provides to the electromagnet a voltage which varies depending upon sunlight at the solar cell. The popper is fabricated so as to have a selected size, shape and mass such that the gas flow from the supply line lifts the poppet away from the valve seat absent attractive forces induced at an electromagnet provided proximate the valve. As varying amounts of sunlight are directed upon the solar cell, electricity travels to the windings of the electromagnet that induces an attractive electromagnetic force upon the valve. The electromagnetic force biases the valve a respective amount towards a closed position, thereby reducing gas flow through the valve. The device further includes a bypass supply line for providing a pilot flow of gas from the gas supply line to the conduit. A bypass valve is provided on the bypass supply line for adjusting the flow of gas through the bypass supply line so that a pilot flow of gas is maintained to the mantel when the valve is in the fully closed position.

11 Claims, 3 Drawing Sheets

ULTRA LOW POWER VALVE FOR THE CONTROL OF GAS FLOW

BACKGROUND OF THE INVENTION

1. Field of the Invention

This invention pertains generally to gas lamps and more particularly with ultra low power devices for reducing or increasing the flow of gas to a lamp under the control of a solar battery. In particular, the invention pertains to electrically operated gas valves used in such applications.

2. Description of the Prior Art

Gas lamps have been in use for well over one hundred years for municipal or commercial lighting and almost as long for residential lighting. Originally, lamps were operated from gas derived from coal or oil. Due to the limited production capacity and subsequent high cost of the gas, lamps were extinguished and relit every night by hand. When the gas supply grew and drove costs down, it was found to be less expensive to leave the lamps burning all day as opposed to paying a lamp lighter to control them.

In the 1970s, the energy crisis drove prices of fuels up greatly. Many people abandoned the use of gas lamps due to the now high operating costs, and for a time a federal prohibition existed against their use to save natural gas.

Several devices have been marketed to save gas during daylight hours. Some of these devices used dry storage batteries and electronics to extinguish and relight the lamps. Other devices employed solar batteries and "snap-action" valves to extinguish the lamps. Snap-action valves abruptly open or close gas flow, rather than transitioning the flow between a high flow rate and a low flow rate.

All of the aforementioned devices are relatively expensive and unreliable. The battery operated devices described above had the added disadvantage of requiring frequent battery replacement. Such devices typically make use of snap-action valves to reduce their electrical requirements. These snap-action valves had the unwanted side effect of occasionally destroying the mantel of the gas lamp. Occasional damage to the gas lamp mantel occurs because the igniter may fail to relight the gas or the battery running the igniter may lose its charge or require replacement. Furthermore, the snap action relight devices would often blow out the pilot flame. If reignition fails to occur for any reason, gas pressure will increase in the mantel head causing the mantel head to break. In addition to these problems, the battery operated relight type devices can have a danger of cracking the mantel head due to the force caused by the ignition of the gas.

An example of such a snap-action relight type device is described in U.S. Pat. No. 4,830,606 to Dillinger. The device of Dillinger utilizes a solar cell, a rechargeable battery, and an electromagnetic gas valve operatively connected to a gas supply and to a mantel head. When solar energy is received at the solar cell, the electromagnetic valve is closed and the igniter is turned off. When a diminished level of light is received at the solar cell, the gas valve is opened and energy is sent through the igniter to cause a discharge spark to ignite the now flowing gas.

Therefore, a device is needed to reduce the flow of gas to a lamp during increased ambient light conditions and to increase the flow of gas during decreased ambient light conditions. Such device should not employ snap acting valves or dry storage batteries. Rather, such a device should be capable of being smoothly throttled between high gas flow rate and low gas flow rate.

SUMMARY OF THE INVENTION

The invention provides a turn down device for regulating gas flow within a gas lamp smoothly, through various degrees of lighting, based upon the amount of sunlight at the lamp. The lamp is of the general type having a lamp post for securing the lamp to ground, a mantel provided at an end of the lamp post and means for delivering gas from a gas supply to the mantel.

The device has a conduit that is configured to allow gas to flow therethrough. A gas supply line connects to the conduit for supplying gas under a selected pressure and flow rate to the conduit. A valve is provided along the conduit downstream of where the supply line connects to the conduit.

The valve is preferably a popper valve, in which the term "poppet valve" is used to mean the combination of a valve seat and a movable member, called a "poppet", that is movable relative to the valve seat. The popper is made of a magnetic material. The magnetic poppet has a valve face that is positioned above and is sealable with the valve seat. The magnetic poppet is fabricated so as to have a selected size, shape and mass such that the gas flow from the supply line lifts the valve popper away from the valve seat (the "open" position of the valve) absent any outside forces. In the open position, gas from the supply line may flow through the popper valve, through the conduit and to the lamp mantels. Thus, absent any outside forces on the popper valve, the lamp is burning.

An electromagnet is provided proximate the valve. A number of solar cells are then operatively connected to the electromagnet, in which the solar cells generate and provide to the electromagnet a voltage which varies depending upon the solar energy incident upon the solar cells. An adjustable mount is preferred for mounting the solar cells to the gas lamp at selectable orientations in order to maximize sunlight exposure on the solar cells.

In operation, the valve is sized and configured such that gas flow through the valve biases the valve to an open position. As varying amounts of solar energy (such as varying degrees of intensity of sunlight) are directed upon the solar cells, the solar cells generate power roughly proportionally to the amount of sunlight. Electrical current then travels through the windings of the electromagnet. The flow of electricity through the windings of the electromagnet induces an attractive electromagnetic force upon the valve which is also roughly proportional to the intensity of the sunlight. The electromagnetic force biases the valve a respective amount towards a closed position, thereby reducing gas flow a proportional amount through the valve.

The device preferably further includes a bypass supply line for providing a flow of gas from the gas supply line to the conduit. The bypass supply line preferably connects to the conduit at a location such that the valve is provided between where the gas supply line connects to the conduit and where the bypass supply line connects to the conduit.

The device further preferably includes a shut off valve provided on the conduit downstream of the bypass line connection to the conduit, between the bypass line connection to the conduit and the mantel. A bypass valve is provided on the bypass supply line for adjusting the flow of gas through the bypass supply line so that a pilot flow of gas is maintained to the mantel when the valve is in the fully closed position.

Other objects and advantages of the invention will become apparent from a description of certain present preferred embodiments thereof shown in the drawings.

DETAILED DESCRIPTION OF THE PREFERRED EMBODIMENTS

Figure 1:
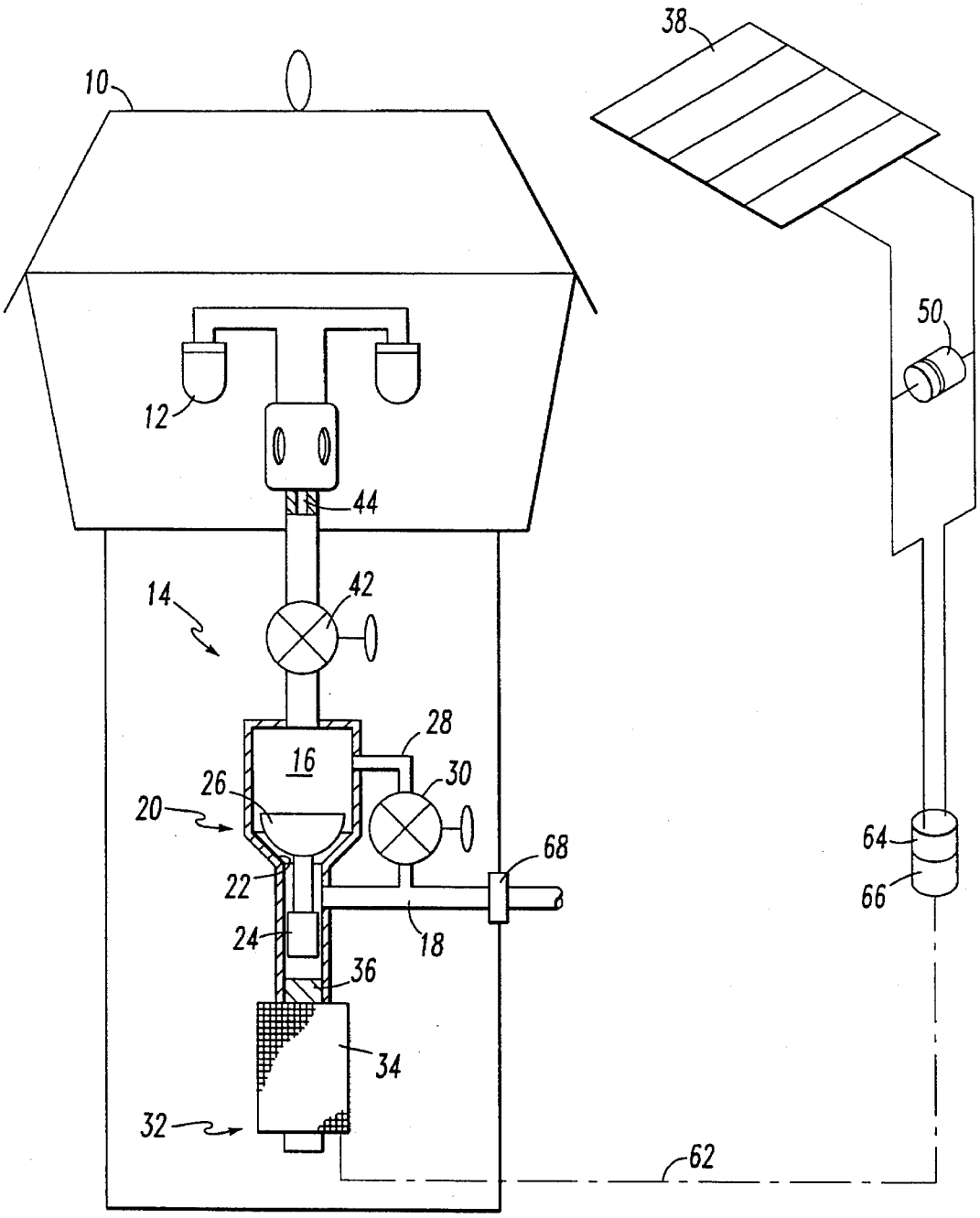
FIG. 1 is a schematic depiction of the preferred turn down device installed in a gas lamp.
Figure 2:
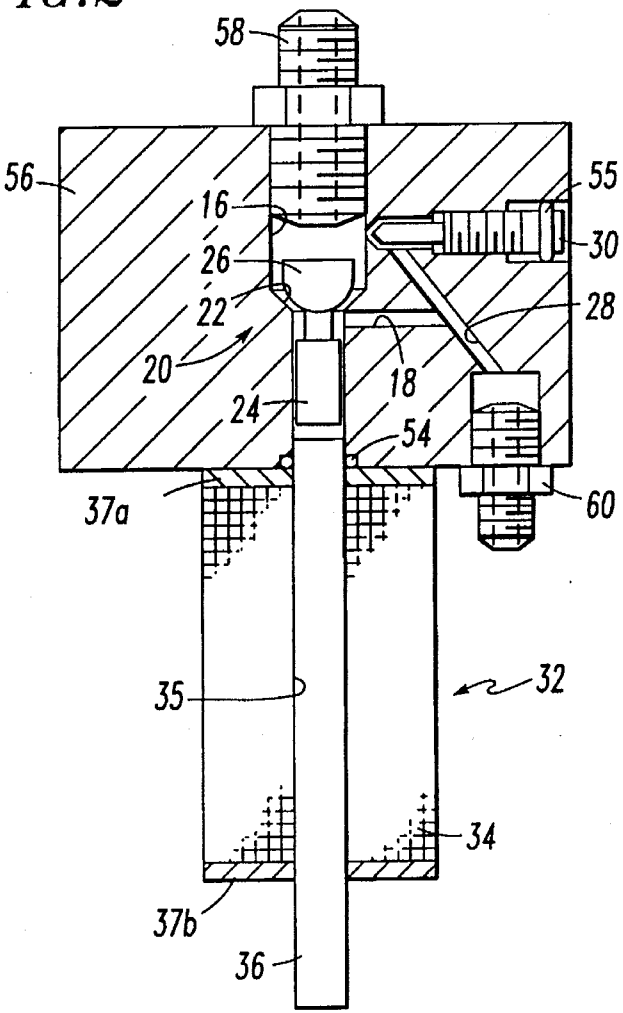
FIG. 2 is a cross sectional view taken in elevation of a first preferred embodiment of a portion of the turn down device.

Referring first to FIGS. 1 and 2, a first preferred turn down device 14 is shown for regulating gas flow from a gas supply line 18 to a mantel 12 within a gas lamp 10. The device 14 provides a smoothly- variable, electrically controlled, normally open popper valve 20 with a user adjustable bypass valve 30. The entire turn down device 14 is designed to fit within a standard three inch gas lamp post. Only the power source is provided external to the post, thereby preventing the device 14 from changing the aesthetic appearance of the gas lamp 10.

The device 14 has a conduit 16 configured to allow gas to flow therethrough. A gas supply line 18 is connected to the conduit 16, and gas under pressure flows from an external gas supply, through the gas supply line 18 and through the conduit 16 to the mantel 12. The precise gas pressure through the supply line 18 is selectable but is preferably set to around 7 oz./in.$^2$ A pressure regulator is preferably utilized which then reduces the gas pressure to between approximately 5½ to 6 oz./in.$^2$ A popper valve 20 is provided along the conduit 16. The term "poppet valve" is used throughout the description to mean a valve seat 22 and a movable member, called a "popper" 24, in combination. The poppet 24 is movable with respect to the valve seat 22. The poppet 24 is made of a magnetic material and the valve seat 22 is preferably machined from a nonmagnetic material such as stock aluminum or an aluminum alloy. The magnetic popper 24 is preferably manufactured from an alloy with very high magnetic permeability and low residual magnetism. The magnetic popper 24 has a face 26 that is provided above and is sealable with the valve seat 22. The poppet valve 20 is provided downstream of the gas supply line 18, such that the valve seat 22 and valve face 26 are located between the gas supply line 18 and the mantel 12. When the magnetic poppet 24 is in sealing contact with the valve seat 22, the flow of gas through the popper valve 20 is stopped and the poppet valve 20 is said to be in a "closed" position.

The magnetic popper 24 is sized and configured and has a selected mass such that when no external forces are acting on the poppet 24, the gas flow from the gas supply line 18 travels through the valve seat 22, lifting the magnetic poppet 24 and thus moving the poppet face 26 away from the valve seat 22 such that gas may continue to flow through the poppet valve 20.

When the popper face 26 of magnetic poppet 24 is separated from the valve seat 22 and allowing gas to flow through the poppet valve 20, such as when no external forces are acting on the poppet valve 20, the poppet valve 20 is said to be in an "open" position. Thus, when the popper valve 20 is in the open position, gas may flow through the poppet valve 20. And, gas may not flow through the popper valve 20 when the poppet valve 20 is in the fully closed position. However, when the poppet valve 20 is in varied positions between the open and the closed positions, varying amounts of gas may flow through the poppet valve 20.

An electromagnet 32 is provided proximate the poppet valve 20. Preferably, the electromagnet 32 is provided below the poppet valve 20, such that the valve seat 22 is disposed between the poppet face 26 of magnetic poppet 24 and the electromagnet 32. The electromagnet 32 is preferably constructed of a winding 34 and a magnetic core 36. The winding 34 has an axial aperture 35 through which the magnetic core 36 is disposed. The core 36 of the electromagnet 32 is preferably manufactured from an alloy having a very high magnetic permeability and a low residual magnetism. The features of the alloy used to construct the magnetic core 36 and the magnetic poppet 24 help to minimize the power required to energize the poppet valve 20 and make the poppet valve 20 resistent to taking on a magnetic set, which could hold the poppet valve 20 in the closed position when the poppet valve 20 has no external forces acting on it and thus should be open. Two caps **37*a*, 37*b* are secured to the core 36 to retain the winding 34. Caps 37*a*, 37*b* are preferably made of a nonmagnetic material and are preferably threadably engaged to the core 36**.

The winding 34 of the electromagnet 32 is shown best in FIG. 2. The winding 34 is constructed preferably of copper wire. The number of turns of the winding 34 shown in FIG. 2 is provided simply representationally, and it is distinctly understood that the number of turns of the winding 34 may be varied.

As can also be seen best in FIG. 2, the conduit 16, the bypass line 28 and the supply line 18 are preferably machined, cast, or otherwise provided as passageways within a housing 56. Connected to the housing 56, preferably by threadable engagement, is a fitting 58 which connects the conduit to the portion of the lamp having the mantel. Also connected, preferably threadably, is a fitting 60 which serves as a portion of the gas supply line 18. The fitting 60 connects to a gas supply external to the device. The valve seat 22 portion of the poppet valve 20 is preferably disposed within the housing 56. An O-ring is are utilized to provide a seal between the cap **37*a* and the housing 56 so that no gas may escape between the housing 56, the cap 37*a* and the core 36**.

As the distance or gap between the poppet 24 and the electromagnetic core 36 decreases, the attractive force of the electromagnet 32 acting on the magnetic poppet 24 increases. This increase in the attractive force aids in keeping the lamp 10 dimmed once activated, however, this boost is not enough to cause a "snap action" (i.e., a sudden and rapid closing of the popper valve 20) to occur. Once the poppet face 26 is seated in sealing contact with the valve seat 22, the flow of gas from the gas supply line 18 is cut off.

To provide an effective seal when the popper valve 20 is in the closed position, the poppet face 26 is preferably machined to be spherical and the valve seat 22 is preferably machined to be conical. This configuration of the valve seat 22 and popper face 26 allows for good metal to metal sealing contact even if a slight misalignment exists between the poppet face 26 and the valve seat 22. This design may assist in extending the service life of the poppet valve 20 since the seal between the poppet face 26 and the valve seat 22 does not require the use of rubber or some other soft, deformable material for its operation.

A bypass supply line 28 is also preferably used for providing a flow of gas to the conduit 16. The bypass supply line 28 connects to the conduit 16 such that the poppet valve 20 is provided along the conduit 16 between the location where the gas supply line 18 connects to the conduit 16 and the location where the bypass supply line 28 connects to the conduit 16. The bypass supply line 28 preferably branches from the gas supply line 18.

A bypass valve 30 is used to control the amount of pilot gas that may flow through the bypass line 28 to the conduit 16. It is preferred that the bypass valve 30 permits a relatively small amount of gas to flow from the bypass supply line 28 to the conduit 16 in order to maintain a pilot flame on the gas lamp mantels 12 when the poppet valve 20 is closed. An O-ring 55 is utilized to provide a seal between the bypass valve 30 and the surrounding housing 56 so that no gas may escape therebetween.

A number of photo-voltaic solar cells 38 are electrically connected to the winding 34 of the electromagnet 32 for generating and providing to the electromagnet 32 a voltage and a current. The solar cells 38 and electromagnet 32 are connected by electrical wiring 62 that connects to the winding 34 of the electromagnet 32. Sections of the electrical wiring 62 may preferably be connected and disconnected such as by the use of a plug 64 and jack 66 arrangement. The voltage generated by the solar cells 38 vary generally proportionally with the amount of solar energy incident upon the solar cells 38. Thus, when light is directed upon the solar cells 38, the solar cells 38 generates electrical power. With increasing light levels, more electrical power is generated by the solar cells 38. The device 14 uses solar cells 38 that are capable of producing much more power than is needed to energize the electromagnet 32 sufficiently to close the popper valve 20 under "full sun" conditions. Each of the preferred solar cells 38 produce approximately 1.5 volts and preferably four or five such solar cells 38 are utilized.

The power generated at the solar cells 38 provide a current flow through the electromagnet 32 which induces an attractive force upon the magnetic popper 24. In this way, the electromagnet 32 biases the magnetic popper valve 24 and therefore the face 26 a respective amount towards the valve seat 22, reducing gas flow through the poppet valve 20 a respective amount. Thus, when light incident upon the solar cells 38 reaches a sufficiently high level, the magnetic field resulting from the current flowing through the electromagnetic coil 34 begins to pull the valve poppet 24 towards the valve seat 22.

The size, shape and mass of the poppet 24 are selected such that with no power applied to the electromagnetic coil 34, the magnetic poppet 24 is kept in separation a distance from the valve seat 22 by "floating" on the gas flowing past it. Thus, the poppet valve 20 is "normally open". When power is applied to the electromagnet 32, the force of magnetic attraction adds to the force of gravity pulling the valve popper 24 toward the valve seat 22 and thereby smoothly reducing the flow of gas to the mantel, dimming the lamp. Thus, it is preferred that the valve poppet 24 is vertically aligned above the valve seat 22 in the device 14.

The device 14 is preferably utilized in connection with a gas lamp 10 having a main shut off valve 42 and an orifice 44 provided along the conduit 16 and downstream of the poppet valve 20 and the connection of the bypass line 28 to the conduit 16. The orifice is a restriction which limits the flow of gas to the mantel 12 a level much less than the flow through the poppet valve 20. Limiting the gas flow to the mantel 12 downstream of the poppet valve 20 reduces the pressure differential across the poppet valve 20 so that the electromagnet 32 does not need to overcome the full line pressure of the gas supply line 18 in order to close the poppet valve 20. Limiting of gas flow at the main shut off valve 42 also provides some compensation against changes in supply line pressure. An external pressure regulator (not shown) is also preferably utilized so that reliable pilot operation and consistent turn on/turn off light levels can be obtained.

Figure 3:
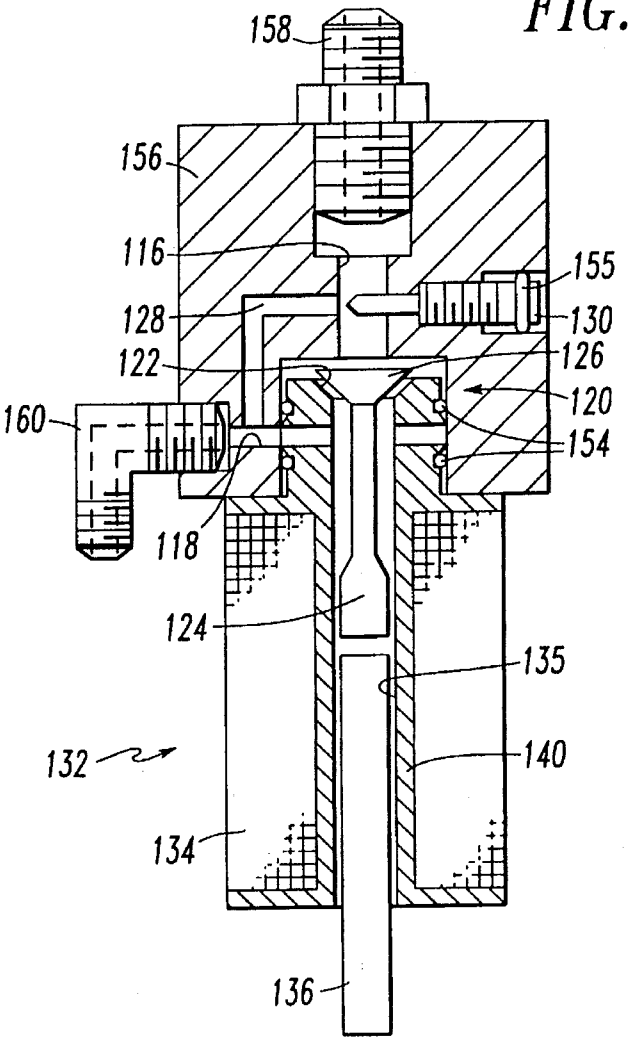
FIG. 3 is a cross sectional view taken in elevation of a second preferred embodiment of a portion of the turn down device.

Referring next to FIG. 3, a portion of a second preferred turn down device 114 is shown, in which like elements of the first preferred turn down device 14 and second preferred turn down device 114 are identified by like reference numerals. The second preferred turn down device 114 operates in a substantially similar fashion to the first preferred turn down device 14 described above. Thus, device 114 provides a smoothly variable, electrically controlled, normally open popper valve 120 having an adjustable bypass valve 130.

The second preferred embodiment of the device 114 has a passageway or conduit 116 that is configured so as to allow gas to flow therethrough. Connected to the conduit 116 is a gas supply line 118. An external gas supply (not shown) provides gas under pressure through a fitting 160 to gas supply line 118 where it enters conduit 116.

Provided along the conduit 116 is a poppet valve 120. The poppet valve 120 has a valve seat 122 and a popper 124. As described above, the valve seat 122 is preferably made of nonmagnetic material such as stock aluminum and the poppet 124 is manufactured from a magnetic material, preferably an alloy having very high magnetic permeability and low residual magnetism. The magnetic poppet 124 has a face 126 that is provided above and is sealable with the valve seat 122. When the poppet face 126 and the valve seat 122 are in sealing contact, so that no gas may pass therethrough, the poppet valve 120 is said to be in the closed position. The popper face 126 is preferably spherical and the valve seat 122 is preferably conical to provide effective sealing despite metal to metal contact. The poppet valve 120 is provided within housing 156 such that the valve seat 122 and popper face 126 are both located downstream of the gas supply line 118.

As with the first preferred embodiment, an electromagnet 132 is provided proximate the poppet valve 120 in the second preferred embodiment of the turn down device 114. The electromagnet 132 is preferably constructed of a winding 134 and a magnetic core 136. The winding 134 has an axial aperture 135 disposed therethrough into which the magnetic core 136 extends. As with the first preferred embodiment described above, the core 136 of the electromagnetic 132 is preferably manufactured from a magnetic alloy having a very high magnetic permeability and a low residual magnetism. Also, the number of turns of the winding 34 shown in FIG. 3 is provided merely representationally, and it is distinctly understood that the number of turns of the winding 134 may be varied.

Preferably, the electromagnetic 32 is positioned below the valve seat 22 and poppet face 26 so that an attractive force provided by the electromagnetic would draw the poppet face 126 toward the valve seat 122 and thus toward the closed position. The electromagnetic 132 and poppet valve 120 thus cooperate in a similar fashion as the electromagnet 32 and poppet valve 20 of the first preferred embodiment. However, in the second preferred embodiment, a portion of the magnetic poppet 124 preferably extends out of housing 156 extending partially within the axial aperture 135 of the winding 134. To accommodate the placement of magnetic popper 124 partially within the axial aperture 135 of the winding 134, the core 136 of the electromagnet 132 is recessed within the axial aperture 135 of winding 134. In this way, a section of winding 134 surrounds a portion of the magnetic poppet 124. A spool 140 preferably retains the winding 134 allowing the poppet 124 to move axially through the winding aperture 135.

The conduit 116, the supply line 118 and the bypass line 128 are preferably provided as passageways within a housing 156. Connected to the housing 156, preferably threadably, is a fitting 158 which connects the conduit to the portion of the lamp having the mantel. Also preferably connected by threading to the housing 156 is a fitting 160 which connects to an external gas supply (not shown).

The valve seat 122 of the poppet valve 120 may either be a part of housing 156 or may be an insert provided within housing 156. In either case, it is preferred that the valve seat 122 is disposed within housing 156. A pair of O-rings 154 are utilized to provide a seal between the valve seat 122 and the housing 156 so that no gas may escape therebetween.

Also connected to the conduit 116 is a bypass supply line 128. The bypass supply line 128 connects to the conduit 116 such that the poppet valve 120 (the valve seat 122 and poppet face 126) are located along the conduit 116 between the location where the gas supply line 118 connects to the conduit 116 and the location where the bypass supply line 128 connects to the conduit 116.

To control the amount of pilot gas that may flow through the bypass line 128 to the conduit 116, a bypass valve 130 is provided. An O-ring 155 is utilized to provide a seal between the bypass valve 130 and the surrounding housing 156, so that no gas may escape therebetween. It is preferred that the bypass valve 130 permits a relatively small amount of gas to flow from the bypass supply line 128 to the conduit 116 so that a pilot flame may be maintained on the lamp mantels when the poppet valve 120 is in the closed position.

As described above with respect to the first preferred embodiment, the magnetic poppet 124 is designed such that gas flow from the gas supply line 118 through the valve seat 122 lifts the magnetic popper 124 when no external forces are acting upon the magnetic poppet 124. When the poppet face 126 of the magnetic poppet 124 is separated from the valve seat 122, the poppet valve 120 is said to be in an open position. Thus, when the poppet valve 120 is in the open position, gas may flow through the poppet valve 120. When the poppet valve 120 is in varied positions between the open and closed positions, varying amounts of gas may flow through the poppet valve 120.

Figure 4:
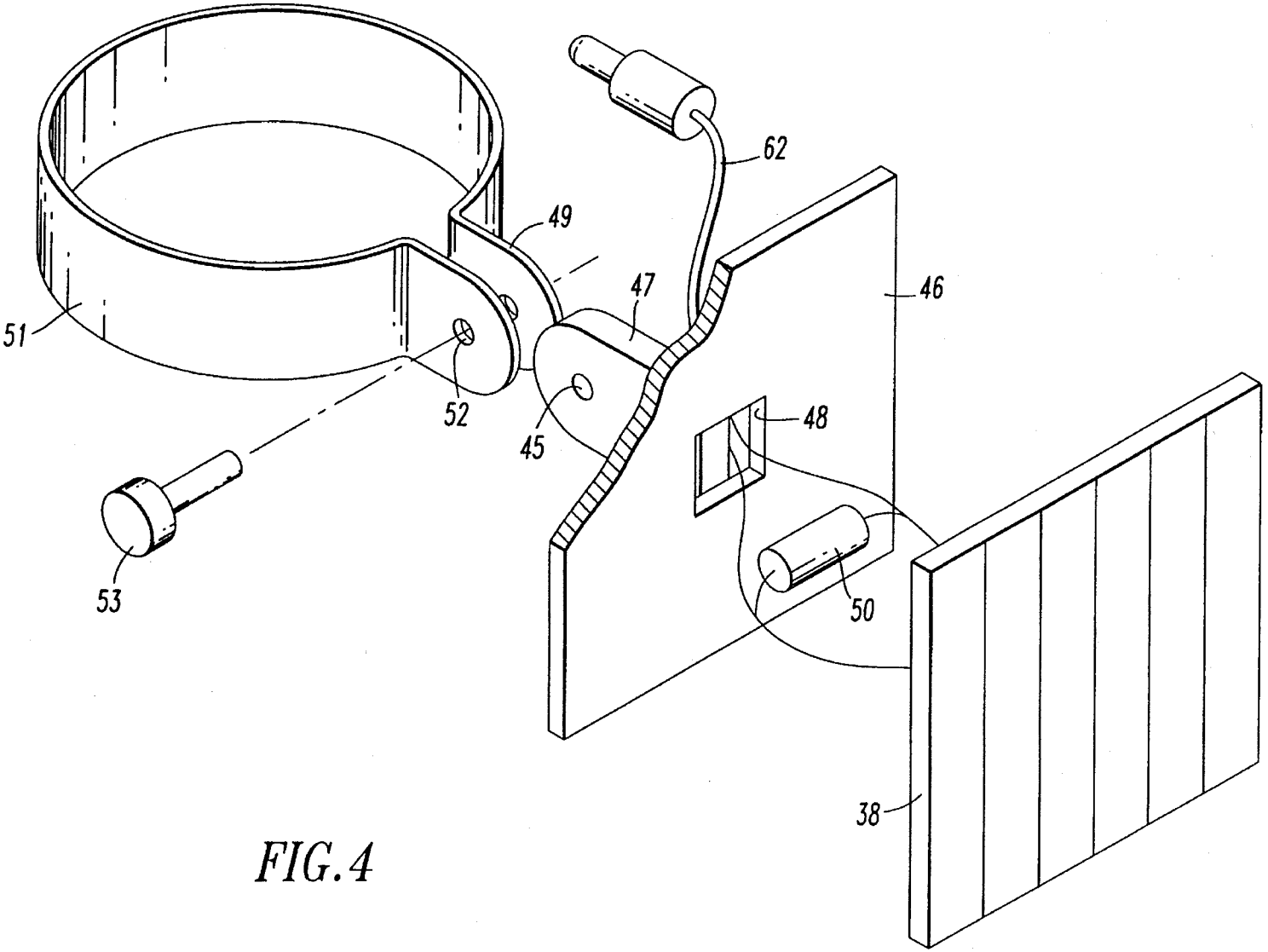
FIG. 4 is an exploded perspective view of a preferred means for mounting the solar cells.

Referring next to FIG. 4, the solar cells 38 are preferably mounted to the lamp post by use of an adjustable mounting means. The adjustable mounting means allows the user to adjust the solar cells 38 to the best angle and direction for optimizing the amount of sunlight incident upon the solar cell 38 throughout the daylight hours.

The solar cells 38 are preferably affixed to a holder 46. The electrical wiring 62 may be disposed around the holder 46 or, as is preferred, may pass through an opening 48 of the holder 46. The holder 46 is equipped with an extending mounting portion 45 having a pin opening 47 disposed therethrough. A clamp 51 is also provided for securing the solar cells to another object and preferably the lamp post. The clamp 51 is thus configured in the shape of the object it is affixed to. As the lamp post is generally cylindrical, the post clamp 51 is generally annular. The post clamp 51 has a portion 49 that extends therefrom and has a pin opening 52 provided therethrough. The holder extending portion 45 and the holder pin opening 47 as well as the clamp extending portion 49 and the clamp pin opening 52 are each sized and configured so that the two pin openings 47, 52 may be aligned. A pin 53 is then disposed through the respective pin openings 47, 52, connecting the clamp 51 to the holder 46 and thus to the solar cells 38.

Once the clamp 51 is attached to an object, the holder 46 may pivot about the pin 53. Also, the annular clamp 51 may be rotated about the lamp post to which it is secured. In this way, a number of orientations of the solar cells 38 are obtainable. If desired, the solar cells 38 can be mounted at a location remote to the lamp 10 in the event that the lamp 10 is located in total shade, or if the operator feels that the solar cells 38 detract from the aesthetics of the lamp 10.

The preferred solar cells 38 have combined dimensions of approximately two and one half inches by two and one half inches, and are capable of producing up to six to seven volts which is more than is needed to activate the electromagnet 32. To prevent the full sun condition from generating too much power and overmagnetizing the magnetic core 36 and popper valve 20, a voltage stabilizing diode 50 is used to shunt excess power away. The diode 50 prevents the voltage from exceeding approximately 5.1 volts.

In some applications, the operator may desire that the activation of respective devices on several lamps be synchronized, such as in a store front on in an amusement park. To provide for this synchronization, the power leads of the respective turn down devices can be paralleled from a light gauge pair of electric wires which are connected to a central array of solar cells or to a low voltage power source which can be controlled by the operator (e.g., at timer, an electric eye or a computer). The voltage and current requirements of the device 14 allow it to be directly controlled by a microprocessor to other digital logic.

It is further preferred that in order to prevent foreign particles or matter from interfering with the operation of the device, a filter and magnetic dust collector 68 are fitted in to the main gas supply line 18. Where a pressure regulator is used, the filter and magnetic dust collector 68 may be mounted on the inlet side of such regulator to keep the regulator clean and to eliminate pressure drop at the filter.

While certain present preferred embodiments have been shown and described, it is distinctly understood that the invention is not limited thereto but may be otherwise embodied within the scope of the following claims.

I claim:

1. A turn down device for regulating gas flow within a gas lamp, the device comprising:

(a) a conduit configured to allow gas flow therethrough;

(b) a gas supply line connected to said conduit for supplying gas under a selected pressure to said conduit;

(c) a valve means provided along said conduit downstream of said supply line;

(d) an electromagnet provided proximate said valve means; and (e) at lease one solar cell operatively connected to said electromagnet for generating electrical power and providing to said electromagnet an electrical current which varies depending upon solar energy incident upon said at least one solar cell;

wherein said valve means is sized and configured such that gas flow through said valve means biases said valve means to an open position, and wherein said solar cell current induces an attractive force at said electromagnet which acts upon said valve means, said attractive force biasing said valve means a respective amount towards a closed position, thereby reducing gas flow through said valve a respective amount.

2. The device of claim 1 further comprising a bypass supply line for providing a flow of gas from said gas supply line to said conduit, wherein said bypass supply line connects to said conduit such that said valve is provided between said gas supply line and said bypass supply line.

3. The device of claim 2 further comprising a shut off valve provided on said conduit downstream of said bypass line connection.

4. The device of claim 2 further comprising a valve provided on said bypass supply line for adjusting the flow of gas through said bypass supply line.

5. The device of claim 1 further comprising an adjustable mount for mounting said at least one solar cell to the gas lamp at selectable orientations.

6. The device of claim 1 wherein said valve means is a poppet valve, said poppet valve having a valve seat and a magnetic poppet, said magnetic poppet having a valve face provided above and sealable with said valve seat wherein said magnetic poppet having a selected size, shape and mass such that said gas flow lifts said valve face away from said valve seat absent attractive forces induced at said electromagnet.

7. The device of claim 6 wherein said poppet face is shaped generally spherically and said valve seat is shaped generally conically.

8. The device of claim 6 wherein said valve seat is fabricated of nonmagnetic metal and said poppet is fabricated of a magnetic metal.

9. The device of claim 8 wherein said valve seat is made of material selected from the group consisting of aluminum and aluminum alloy.

10. The device of claim 8 wherein said poppet face is shaped generally spherically and said valve seat is shaped generally conically.

11. The device of claim 6 wherein said electromagnet comprises a winding having an axial aperture extending therethrough and a magnetic core extending within said winding aperture, and wherein said magnet popper is extendable partially within said winding aperture.

* * * * *

UNITED STATES PATENT AND TRADEMARK OFFICE

CERTIFICATE OF CORRECTION

PATENT NO. : 5,503,549

DATED : April 2, 1996

INVENTOR(S) : CARLO IASELLA

It is certified that error appears in the above-indentified patent and that said Letters Patent is hereby corrected as shown below: Title page At [57] Abstract, line 10, change "popper" to --poppet--.

At column 10, line 18, claim 11, change "popper" to --poppet--.

Signed and Sealed this

Twenty-seventh Day of August, 1996

*Attest:*

Bruce Lehman

BRUCE LEHMAN

*Attesting Officer*

*Commissioner of Patents and Trademarks*